US006438923B2

(12) United States Patent
Miller

(10) Patent No.: US 6,438,923 B2
(45) Date of Patent: Aug. 27, 2002

(54) METHOD OF ASSEMBLING LIGHTWEIGHT SANDWICH WALL PANEL

(76) Inventor: John F Miller, 47-169 B Hui Akepa Pl., Kaneohe, HI (US) 96744

( * ) Notice: Subject to any disclaimer, the term of this patent is extended or adjusted under 35 U.S.C. 154(b) by 0 days.

(21) Appl. No.: 09/316,202

(22) Filed: May 21, 1999

(51) Int. Cl.[7] ..... E04C 2/288

(52) U.S. Cl. ..... 52/745.19; 52/309.7; 52/309.11; 52/309.12; 52/405.3; 52/794.1; 264/254; 264/274; 264/279.1

(58) Field of Search ..... 52/309.7, 309.9, 52/309.11, 309.12, 794.1, 742.14, 745.19, 405.3; 264/279.1, 275, 274, 254, 46.4, 46.7

(56) References Cited

U.S. PATENT DOCUMENTS 2,126,301 A * 8/1938 Wolcott ..... 52/600 X
2,235,001 A * 3/1941 Allen ..... 264/69
3,879,908 A * 4/1975 Weismann ..... 52/309.12 X
4,226,067 A * 10/1980 Artzer ..... 52/309.12
4,280,974 A * 7/1981 Piazza ..... 264/69
4,297,820 A * 11/1981 Artzer ..... 52/309.12 X
4,394,201 A * 7/1983 Haeussler ..... 264/274 X
4,489,530 A * 12/1984 Chang ..... 52/309.12 X
4,505,019 A * 3/1985 Deinzer ..... 52/309.12 X
4,611,450 A * 9/1986 Chen ..... 52/309.12 X
5,119,606 A * 6/1992 Graham ..... 52/309.11 X
5,372,769 A * 12/1994 Ryberg ..... 264/254
5,398,470 A * 3/1995 Ritter et al. ..... 52/309.11
5,440,845 A * 8/1995 Tadros et al. ..... 52/309.12
5,588,272 A * 12/1996 Haponski ..... 52/309.12
5,697,189 A * 12/1997 Miller et al. ..... 52/309.12 X
6,000,194 A * 12/1999 Nakamura ..... 52/309.12 X

* cited by examiner

*Primary Examiner*—Laura A. Callo

(57) ABSTRACT

The present invention relates to an improved casting process of mass producing complete lightweight cementitious house walls. More specifically, the invention relates to the manner in which thin cementitious skins are separately cast on either face of the wall against a sub-assembly of thick panels of insulation material shaped and located in a manner to control the movement of displaced cementitious fluid so that the exposed top and bottom chords of small vertical structural trusses, sandwiched between these the panels of insulation and other perimeter reinforcing members are encased with the least amount of cementitious material. The size and strength of each wall component can be varied to achieve the specific characteristics of the wall. Smooth or textured faces in the casting beds reproduce whatever profiles are of required on the finished walls. Accurate window and door openings are cast in such a manner as to eliminate the need for trim. These completed wall panels enable the rapid assembly of many houses, with factory controlled quality and cost controls.

13 Claims, 5 Drawing Sheets

METHOD OF ASSEMBLING LIGHTWEIGHT SANDWICH WALL PANEL

FIELD OF INVENTION

The present invention relates to an improved method of progressively and horizontally casting lightweight sandwich panels to create house wall panels.

BACKGROUND OF THE INVENTION

Conventional house construction traditionally consists of obtaining many small components from many sources and physically assembling these many components in a predetermined sequence, usually out in the prevailing weather conditions with skills of many different tradesmen divided up into many sub-contracts. Supervision is infrequent, consequently the quality of the finished house is largely determined by the skills and integrity of each of the tradesmen. These are very inefficient methods of assembling any product, especially products as expensive and complex as large housing projects.

The selection of house construction materials has evolved slowly and usually combines the least expensive acceptable materials with the skills of available tradesmen. The building industry has focused on establishing standards for each component, for example framing lumber, siding, insulation, The size of each of these components is standardized in order to control costs and reduce waste.

There is a great need to for a simple method of combining all of these components into one product and manufacturing this product on a mass production basis, creating houses that are more durable, much easier to assemble, yet retain the appearance of a typical house.

One such invention, U.S. Pat. No. 5,697,189 granted to John & Andrew Miller on Dec. 16 1997 describes a wall suitable for casting in a mass production process.

This specific patent discloses a type of cementitious wall with blocks of insulative material each completely surrounded by a monolithically poured cementitious material with a continuous upper track and a projecting floor connection means. Other claims include vertical cementitious ribs reinforced with vertical steel reinforcing bars, accurately cast window and door openings. The subsequent assembly of these completed walls on site simplifies house construction The actual method of assembling and casting this said wall is not described in detail, however anyone skilled in the art of creating very thin cementitious skins on a large sandwich wall panel, with a central core of expanded polystyrene, will realize the necessity to progressively cast this wall in a horizontal position. The first thin skin is applied evenly to a horizontal form tray, then an assembly of expanded polystyrene panels and steel reinforcing is applied to this first fluid cementitious skin, followed by the application of second fluid cementitious skin applied over the upper face. This application of this second cementitious skin includes filling the voids between the expanded polystyrene panels and completely encasing each panel. This second skin also provides a method of bonding both skins together and encasing the steel reinforcing on both faces of the wall. The face of the first skin cast against the form tray reproduces whatever texture is on the face of this form tray. The face of the second exposed skin is mechanically finished with trowels, usually with a smooth finish.

The manufacture of this particular product as described in this existing patent has a number of inherent manufacturing and design problems. The use of monolithically poured cementitious material as a means of connecting both faces of the wall panel together at the vertical ribs. In addition the structural design of the rib necessitates of total encasement of these vertical steel reinforcing elements. More specific details are as follows;

The first disadvantage of this existing patent is the necessity to and inability of ensuring that voids do not occur in the central portion of these ribs. Considerable difficulty is experienced in ensuring that the fiber filled cementitious fluid continuously flows into the narrow joints between blocks of insulative material and upper steel reinforcing bar without creating air pockets. Voids in the rib area greatly impairs the structural integrity of the entire wall panel.

Another disadvantage of this existing patent is the necessity to and inability of ensuring a continuous bond along the wet joint line between the first wet lower skin of the wall panel and the second skin the cementitious fluid designed to flow between the blocks of insulation and bond both sides of the panel together with cementitious fluid. Failure to continuously bond both sides of the panel together in this rib area also greatly impairs the structural integrity of the entire wall panel.

Another disadvantage is the reliance on the tensile strength of the fibers in the cementitious rib area providing the only tensile connection between the steel reinforcing bars on either face of the panel. It was not possible to achieve the full potential of the strength of the steel reinforcing bars in solid ribs and the strength of the fibers proved to be inconsistent Another disadvantage is that the wall as described in this existing patent is limited in its application to single level houses with solid concrete floors, cast on the ground. There is no connection provision for walls for upper floors and no provision for floors above ground or between floors for any other type of construction.

Another disadvantage is that the projecting connecting bars at the bottom of the wall protrude beyond the wall face, creating difficulties in the manufacturing process and difficulties with temporary storage when panels are stacked against each other.

Another disadvantage is the method of obtaining a smooth finish on the upper face of the second skin of cementitious fluid. It is necessary to this wait for the surface of the second skin of the cementitious material to partially solidify and then repeatedly trowel this surface as it hardens. The timing of this solidifying process is unpredictable and the finishing procedure is a time consuming process, not suitable for an industrial process. The trowelled upper surface results in an undulating imperfect surface, in contrast to the precision of the face of the first skin cast down against the surface of the form tray.

SUMMARY OF THE INVENTION

The primary object of this invention is to eliminate the foregoing manufacturing and structural flaws found in this prior patent, and although this present invention retains the external appearance of the wall as described in the prior patent, the method of manufacture and the technical description of this new invention is very different.

One improvement to the prior patent is the use of a vertical welded steel truss in the vertical ribs between the edges of the beveled insulation blocks that replaces the individual vertical steel reinforcing bars on either face of the wall. These rib trusses are constructed out of small diameter deformed steel chords, electrically welded to interconnecting small diameter steel diagonal bracing members. These trusses are ultimately provided with lateral stiffness by both locally thickened cementitious skins, with the truss ends restrained in solid cementitious material at the top and bottom of the wall. Both chords of these trusses initially remain fully exposed and are subsequently encased with the cementitious fluid.

Another improvement to the prior patent is the use of the many interconnecting diagonal bracing members of the vertical trusses as the means of connecting both independent skins of the wall together. The small diameter steel diagonal bracing members of these trusses are sandwiched between the sides of the beveled blocks of insulation. This eliminates the use of wet cementitious material of the second skin to bond to the wet face of the first skin and the use of the fiber in the cementitious material in the central rib area providing the tensile connection between the steel reinforcing bars on either face of the panel.

Another improvement is encasing the lower chord of these rib trusses with cementitious fluid of the first skin by submersing the face of the subassembly of insulating panels and trusses until the lower chord of the trusses are fully encased in cementitious fluid. This also eliminates the need to encase the reinforcing steel on the lower first face with cementitious fluid from the second skin.

Another improvement is the method of controlling the thickness of the first skin by forcing down this internal subassembly down to a predetermined position, with the excess cementitious fluid being displaced to ends of the insulation panels.

Another improvement is casting the second face of the wall panel by waiting until the first skin has solidified then rotating this entire first assembly into a second wet cementitious skin on a separate casting bed in a similar manner to casting the first skin. This provides an excellent predictable finish to the second skin. This avoids waiting for the surface of the second skin to solidify and eliminates all surface trowelling, greatly improving the quality of this second face of the wall.

Another improvement is providing the bottom of the wall with an temporary aligning and connecting device that ultimately provides a permanent connection to the structure below this wall, that does not protrude beyond the wall face, so that walls can be temporarily stacked against each other during handling and shipping.

Another improvement is providing the top of the wall with recesses to accommodate the permanent attachments to the top of this wall, including floors above ground level, second floors, walls on walls, and roof structures including preassembled roofs. A continuous track to accommodate temporary handling devices and other permanent connections is desirable but not essential.

During the making and testing experimental panels it was discovered that it was not necessary to encase the diagonal bracing members of the rib trusses in concrete and only necessary to encase the top and bottom chord of these rib trusses in concrete skins. This in turn isolated the cementitious skins on either face of the panel from each other and improved the value of the insulation panels in this wall.

The specific design of this sandwich wall panel is substantially different from the prior art. The panel manufacturing procedure is greatly improved by avoiding the use of cementitious material in the rib area. The cast surface finish on the second wall face is superior. The strength of this panel increased and the weight of this wall panel reduced The casting of separate skins allows the use of different types of cementitious materials, such as fire rated or high impact skin on one or more wall faces.

DESCRIPTION OF DRAWINGS

Figure 1:
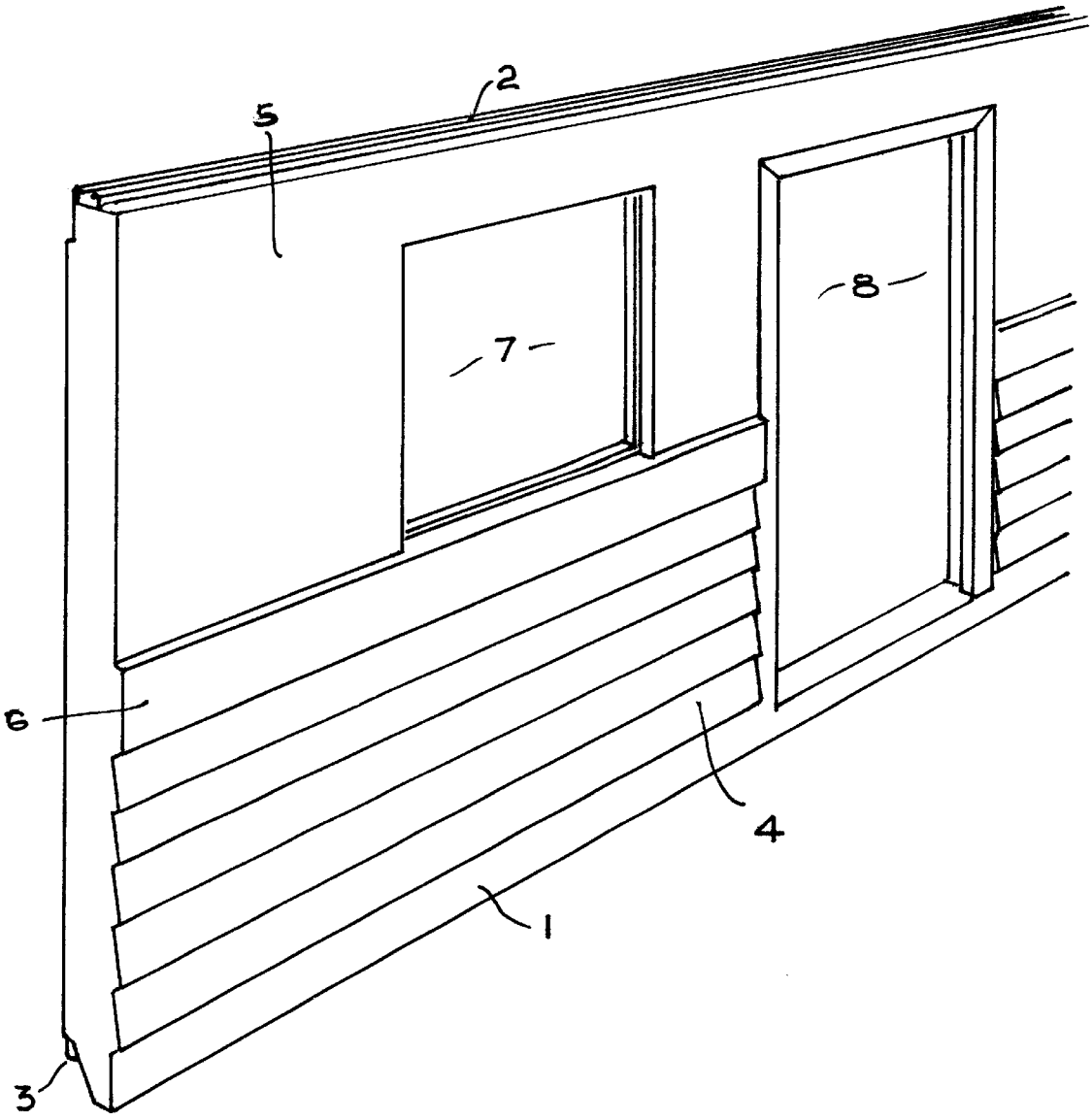
FIG. 1 is isometric view of the finished wall

FIG. 1 illustrates an exterior view of a house wall (1) with an upper connecting device (2) and a lower connecting device (3), a horizontal siding pattern (4), a smooth exterior wall face (5) above a decorative horizontal wood grained beam (6), a window opening (7) and a door opening (8).

Figure 2:
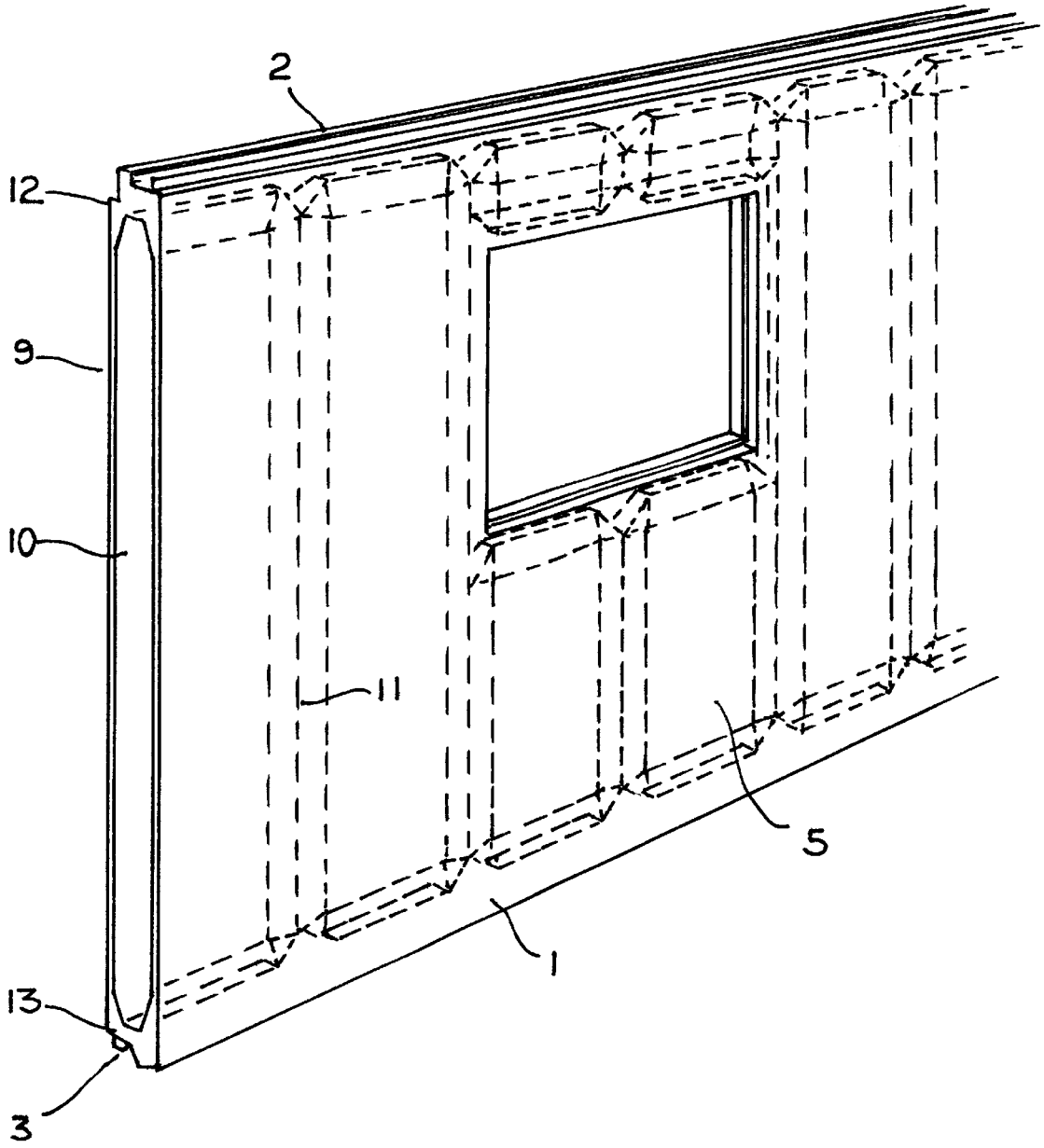
FIG. 2 is isometric view of wall showing the blocks of insulation inside the wall.

FIG. 2 illustrates a vertical section through the house wall (1) a smooth exterior wall face (5) and inner wall skin (9) encapsulating panels of expanded polystyrene (10). Between these vertical panels of expanded polystyrene (10) are vertical reinforced ribs (11), near the top of the wall (12) and bottom of the wall (13) are thickened portions of cementitious material. At the top of the wall are connection device (2) and at the bottom of the wall a connection and alignment device (3)

Figure 3:
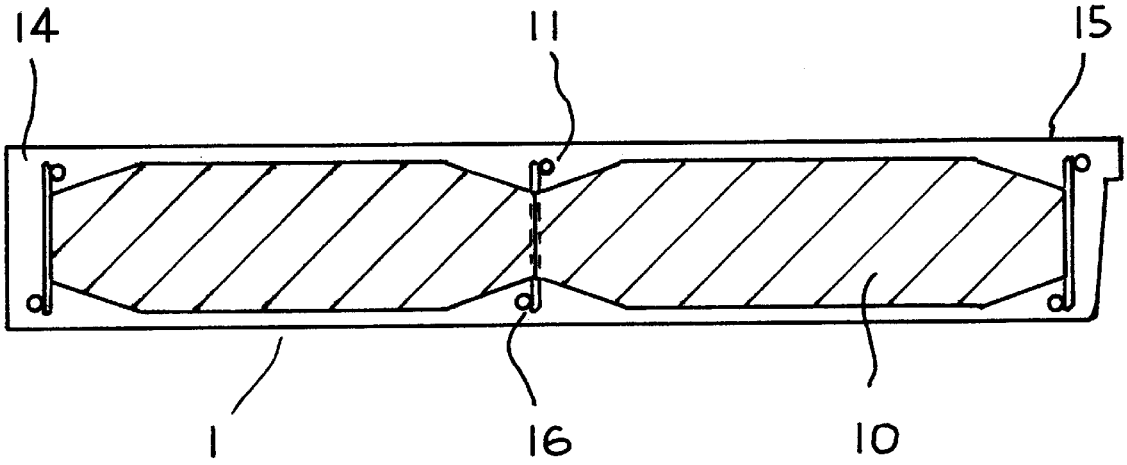
FIG. 3 is a horizontal section through the finished wall

FIG. 3 is a horizontal section through the wall(1) showing a typical rib (11), atypical end rib (14) and a window opening rib (15). Sandwiched between the panels of insulation(10) are the steel rib trusses(16).

Figure 4:
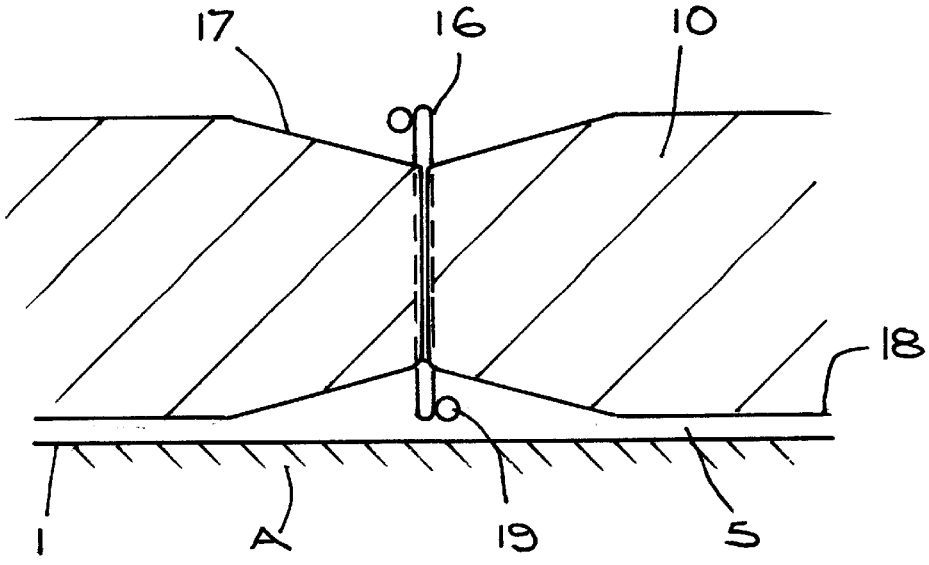
FIG. 4 is a horizontal section through a single vertical rib during the casting of the first skin.

FIG. 4 is an enlarged horizontal section through a single typical rib (11 ) showing the steel rib trusses (16) between the panels of insulation (10) with tapered edges (17) with the lower face of this wall sub-assembly (18) immersed in the first cementitious layer of the exterior skin (5) on the horizontal casting bed (A) and the lower chord (19) of the trusses (16) encased in this first cementitious layer (5).

Figure 5:
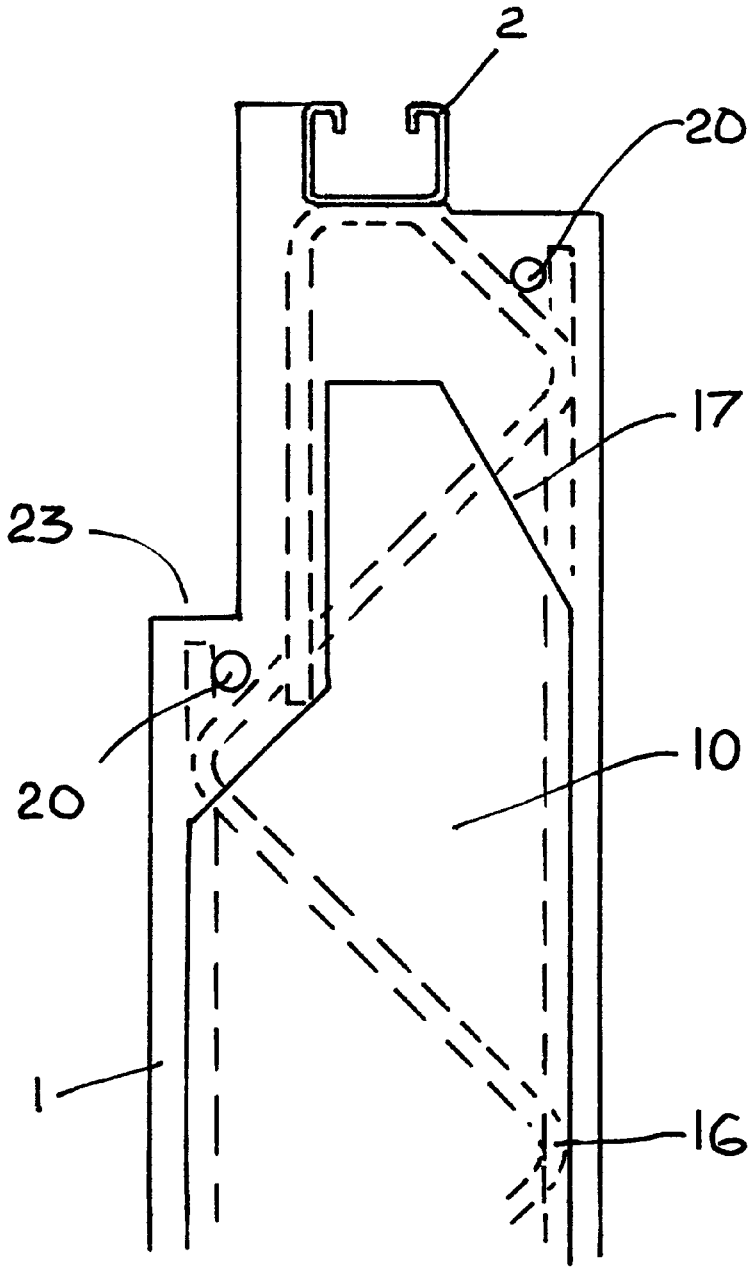
FIG. 5 is enlarged section through the top of the wall

FIG. 5 is a vertical section through the upper edge of the wall (1) showing an upper connection device (2) and tapered edges (17) the insulation panels (10) with horizontal steel reinforcing (20) and the vertical steel trusses (16) sandwiched between vertical panels of expanded polystyrene (10). A recess (23) is shown on the interior face of this wall.

Figure 6:
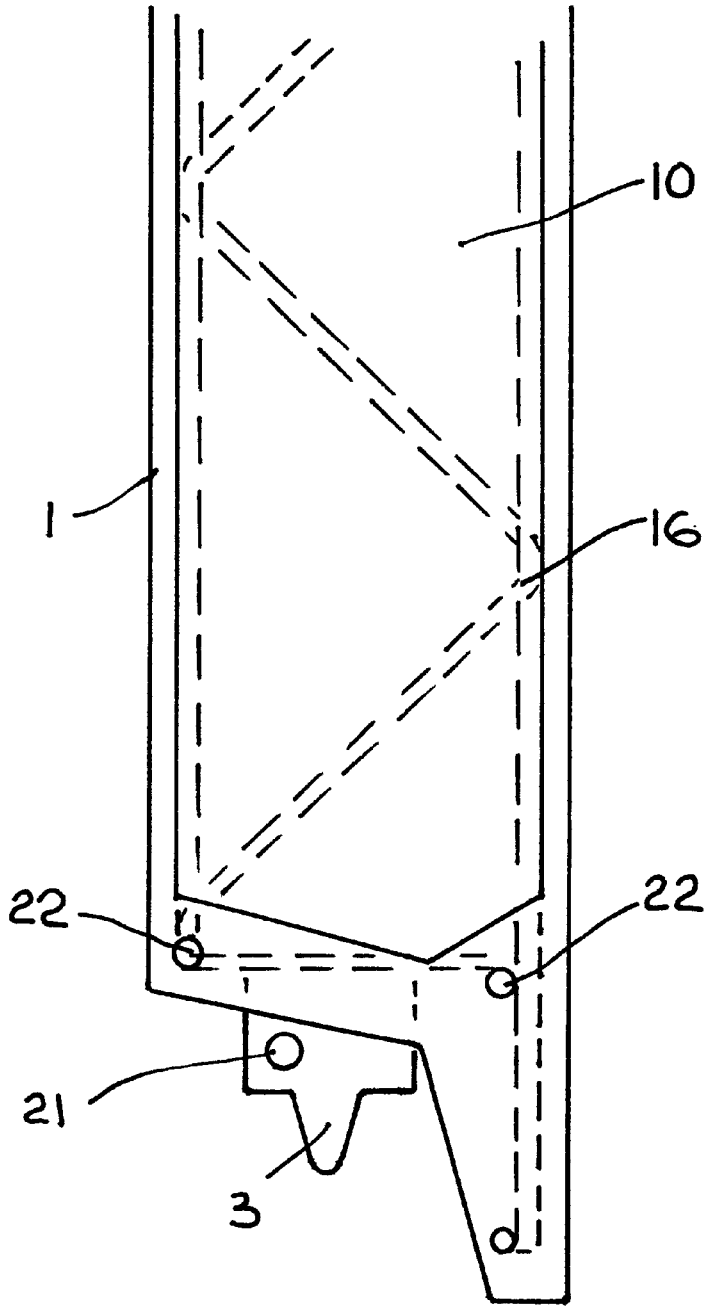
FIG. 6 is enlarged section through the bottom of the wall

FIG. 6 is a vertical section through the lower edge of the wall (1) showing an aligning and connecting device (3) and provision for a floor connecting device (21 ) and insulation panels (10) and a horizontal steel reinforcing (22), and vertical steel trusses (16) between vertical blocks of expanded polystyrene (10)

DETAILED DESCRIPTION OF INVENTION

The preferred embodiment of the invention is illustrated in the attached drawings which are referred to herein. The same reference numerals will be used to identify identical elements throughout the drawings.

FIG. 1 illustrates a wall (1) with some of the many exterior surface textures that be cast in the face of this wall, a smooth face (5), a siding face (4) together with an accurately cast window opening (7) and a cast in door opening (8). This horizontal casting process can be used duplicate almost any texture or profile on at least one face of this wall. The size of the casting bed determines the maximum length and height of the wall panel. The surface texture on the face of the casting bed determines the surface texture on both faces of the finished wall (1).

FIG. 2 illustrates the manner in which vertical insulation panels (10) are used to control the movement of the cementitious fluid in the cavities between these insulation panels (10) and the beveled edges (17) on the insulation panels (10) ensure the progressive change in the thickness of the cementitious material during the wall casting process. All of these panels of insulation are preassembled together in a lightweight steel frame that is described in FIGS. 3, 4, 5 and 6. At the top of the wall (12) and bottom of the wall (13) are thickened portions of cementitious material that encapsulate horizontal reinforcing and the ends of the vertical rib reinforcing.

FIG. 3 is a typical horizontal section through a completed wall that includes a typical rib (11), a typical end rib (14), at rib (15) at window opening (7) and illustrates the manner in which the internal components of the wall (1) are preassembled with vertical rib trusses (16) spanning from top to bottom of the wall sandwiched between panels of insulation (10). The depth of the steel rib trusses (16) and the thickness of the insulation panels(10) are similar and all vertical edges of the insulation panels (10) are beveled (17) to allow the cementitious material to flow around the steel truss chords (19) and retain the desired skin thickness over the insulation panels(10) and around the steel rib trusses (16). The cementitious material of the exterior wall face (5) and interior wall face (9) are independent of each other except at the exposed edges of the wall panel (1) such as at the window openings (7), a typical end rib (14), and at the top and bottom edges of the wall (1) as shown on FIGS. 2, 5, and 6. During the casting of the exterior wall face (5) additional cementitious material is applied to the voids at all edges and openings in the wall panel.

FIG. 4 is a enlarged typical horizontal section through a partially completed typical vertical rib (11) within the wall (1) and illustrates the manner in which the lower face (18) of this entire horizontal sub- assembly of the insulation panels (10) and steel rib trusses (16) is forcibly submersed in the first layer of cementitious fluid (5) on to a horizontal casting bed (A) and the displaced cementitious fluid encases the lower chord (19) of the steel trusses (11).

FIG. 5 is a vertical section through the upper edge of the wall (1) showing an upper connection device (2) that includes provision to permanently connect the top of the wall to at least one of the following elements, the wall above, the roof and ceiling and as part of the temporary lifting and handling mechanism. The profile of the beveled edges of the insulation panels (17) is shaped to provide the upper horizontal steel reinforcing bars (20) and the vertical steel trusses (16) sandwiched between vertical panels of expanded polystyrene (10) with the minimum amount of cementitious fluid to encase these steel reinforcing members. The top of this wall (1) may be provided with a recess (23) on the internal face of the wall to accommodate a floor or ceiling panel.

FIG. 6. is a vertical section through the lower edge of the wall (1) showing a device (3) to align and permanently connect this wall to a structure below. A floor connecting device (21) is also provided to permanently connect this wall to the floor. The profile of the lower edge of the wall includes provision to connect the bottom of the wall to at least one of the following elements, the wall below, the floor, the subsequently cast floor topping, the foundation below. The profile of the beveled edges of the insulation panels (17) is shaped to provide the lower horizontal steel reinforcing bars (22) and the vertical steel trusses (16) sandwiched between vertical panels of expanded polystyrene (10) with the minimum amount of cementitious fluid to encase these steel reinforcing members.

I claim:

1. A method of progressively assembling a cementitious wall panel with cementitious skins on each face of the said wall panel encasing a central subassembly which comprises at least two rectangular blocks of insulation material abutting each other, encapsulating a structural element, said insulation blocks and said structural element extending substantially the entire height of said wall panel with the abutting edges of said insulation material beveled in such a manner as to sufficiently expose portions of said structural element, wherein at least a first skin is cast by forcibly immersing a first face of said central subassembly in a thin layer of fluid cementitious material so that said displaced cementitious material is directed to surround those exposed portions of said structural element with a minimum thickness at least equal to the thickness of said skin, further wherein along a top edge of said wall panel, attachment means are formed therein, adapted to facilitate the joining of the top of said wall panel with an adjacent structure, and wherein attached to a bottom edge of said wall panel is a device to connect said bottom edge to an adjacent structure.

2. A method of assembling a wall panel as described in claim 1 where a second skin is cast by rotating a partially completed assembly comprising said central assembly with said first skin on the first face thereof and immersing the second face of said partially completed assembly in a second layer of fluid cementitious material so that displaced cementitious material surrounds the exposed structural element on this second face, creating a sandwich panel.

3. A method of assembling a wall panel as described in claim 1 in which said structural element connects the skins together and is a truss comprising at least two parallel chords and interconnecting diagonal bracing.

4. A method of assembling a wall panel as described in claim 1 in which said structural element spans vertically from top to bottom of said wall panel, providing a primary structural component to said wall panel.

5. A method of assembling a wall panel as described in claim 4 in which ends of said vertical structural element are connected to secondary horizontal structural elements spanning lengthways along said wall panel and the structural elements are cast in the cementitious material.

6. A method of assembling a wall panel as described in claim 1 wherein ends of said insulation material along both the top and bottom edges of said wall panel are beveled in such a manner as to fully expose and encase said secondary horizontal structural elements in the cementitious material.

7. A method of assembling a wall panel as described in claim 1 wherein a textured surface can be cast in one or more faces of said wall panel.

8. A method of assembling a wall panel as described in claim 1 wherein said cementitious material is reinforced with fiber.

9. method of assembling a wall panel as described in claim 1 wherein said blocks of insulation material are expanded polystyrene.

10. A method of assembling a wall panel as described in claim 1 wherein the edges of said insulation material are beveled in a manner as to progressively change the thickness of the cementitious skins, avoiding any abrupt change in skin thickness.

11. A method of assembling a wall panel as described in claim 1 wherein the attachment means formed in the top edge of said wall panel comprise provisions to connect the top of the wall panel to the base of a similar wall panel.

12. A method of assembling a wall panel as described in claim 1 wherein the attachment means formed in the top edge of said wall panel comprise connections for connecting the wall panel to a roof structure.

13. A method of assembling a wall panel as described in claim 1 wherein the device attached to the bottom edge of said wall panel comprises provisions to connect the bottom of said wall panel to at least one of the following elements a wall below, a floor below, and a foundation below.

* * * * *